US009170042B2

(12) United States Patent
Tenbarge et al.

(10) Patent No.: US 9,170,042 B2
(45) Date of Patent: Oct. 27, 2015

(54) THIN MOLD ICE HARVESTING

(71) Applicant: Whirlpool Corporation, Benton Harbor, MI (US)

(72) Inventors: Andrew M. Tenbarge, Saint Joseph, MI (US); Yen-Hsi Lin, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 266 days.

(21) Appl. No.: 13/832,426

(22) Filed: Mar. 15, 2013

(65) Prior Publication Data

US 2014/0260406 A1 Sep. 18, 2014

(51) Int. Cl.
*F25C 1/10* (2006.01)
*F25C 5/06* (2006.01)

(52) U.S. Cl.
CPC ..... *F25C 5/06* (2013.01)

(58) Field of Classification Search
CPC ..... F25C 1/10; F25C 5/06; F25C 2305/022; F25C 1/04; F25C 5/08; F25C 5/185; F25C 5/10; F25C 1/24; F25D 11/02; F25D 23/12; F25D 23/04
USPC ..... 62/340, 353, 349, 350, 137
IPC ..... F25C 1/10, 5/06, 2305/022, 1/04, 5/08, F25C 5/185, 5/10, 1/24; F25B 11/02, 23/12, F25B 23/04
See application file for complete search history.

(56) References Cited

U.S. PATENT DOCUMENTS

| | | | | |
|---|---|---|---|---|
| 2,217,681 | A | 10/1940 | Jennings et al. | |
| 2,351,742 | A * | 6/1944 | Buchanan | 249/71 |
| 2,757,519 | A | 8/1956 | Sampson | |
| 2,839,899 | A | 6/1958 | Baillif et al. | |
| 2,990,692 | A | 7/1961 | Hubacker et al. | |
| 3,021,978 | A | 2/1962 | Cunliffe | |
| 3,217,511 | A | 11/1965 | Keighley | |
| 3,330,128 | A * | 7/1967 | Wilson | 62/137 |
| 3,929,256 | A | 12/1975 | Solomon | |
| 4,843,827 | A | 7/1989 | Peppers | |
| 4,990,169 | A * | 2/1991 | Broadbent | 62/72 |
| 5,172,556 | A | 12/1992 | Oike | |
| 6,044,658 | A | 4/2000 | Ryu | |
| 6,860,111 | B2 * | 3/2005 | Sanuki et al. | 62/74 |
| 2012/0047918 | A1 | 3/2012 | Herrera et al. | |

* cited by examiner

*Primary Examiner* — Mohammad M Ali

(57) ABSTRACT

An ice maker includes an ice tray which is moveably mounted to a housing and operable between ice forming and ice harvesting positions. The ice tray comprises a generally planar body portion having a plurality of ice forming cavities disposed thereon. A harvesting mechanism, including retractable or fixed contacting members, is adapted to engage and deform the ice tray when the ice tray is in the ice harvesting position for facilitating release of formed ice structures during an ice harvesting process. The ice tray is a thin mold ice tray which is flexibly resilient, such that the ice tray is adapted to return to an at-rest position from a deformed position when the ice tray is no longer being urged to the deformed position by the harvesting mechanism.

20 Claims, 7 Drawing Sheets

THIN MOLD ICE HARVESTING

FIELD OF THE INVENTION

The present invention generally relates to an ice maker for producing ice structures, and methods for harvesting the formed ice structures. More specifically, the present invention relates to an ice maker and methods associated therewith, wherein an ice maker comprises a thin mold ice tray that is flexibly resilient, such that the thin mold ice tray can be deformed by an harvesting mechanism disposed in the ice maker to facilitate the harvesting of formed ice structures.

BACKGROUND OF THE INVENTION

Refrigerators requiring lower energy are needed to meet government and consumer needs. An area of high potential to reduce energy consumption from the refrigerator lies in the ice maker. Current ice makers use a heater to melt the ice to icemaker bond formed during ice formation and a motor to remove the cubes from the mold. This method requires power for the heater and then power for the refrigerator/freezer to remove the excess heat from this heater. Another common type of ice maker is the twist icemaker, which uses a plastic tray that is twisted by a motor to help remove formed ice structures.

During the ice harvesting process, formed ice structures are generally released from an ice tray into an ice storing container. As most ice trays include several ice formation cavity structures, each ice structure formed therein must be separately released during the ice harvesting process. Several methods of facilitating the release of formed ice structures from the ice tray have been used including tray inversion, heating of the ice tray to break bonds with ice structures formed therein and specific coatings used on the ice tray to facilitate release. While these methods have generally facilitated the release of formed ice structures from an ice tray, improvements on the consistency of ice structure release from the ice tray, prolonged ice tray use life, and overall reduced energy consumption is still desired.

The present invention provides a thin mold ice tray that is flexibly resilient such that the ice tray can be deformed during the ice harvesting process to better ensure consistent release of ice structures from the ice tray.

SUMMARY OF THE INVENTION

One aspect of the present invention includes an automatic ice maker comprising a housing having an ice tray moveably mounted within in the housing. The ice tray is moveable between an ice forming position and an ice harvesting position and includes a generally planar body portion having a plurality of ice forming cavities disposed thereon. Each ice forming cavity includes an open top and a closed bottom surface to receive a liquid and hold that liquid to form ice structures in the cavities. A harvesting mechanism is coupled to the housing and is operable between a retracted position and an extended position. The harvesting mechanism is adapted to engage and deform the ice tray when in the extended position to facilitate the release of ice structures formed in the ice tray.

Another aspect of the present invention includes an automatic ice making having a housing with an ice tray rotatably mounted within the housing. The ice tray is operable between an upright ice forming position and an inverted ice harvesting position. The ice tray further comprises a generally planar body portion having a plurality of open ice forming cavities disposed thereon. Each ice forming cavity includes an open top and a closed bottom for receiving a liquid and holding the liquid to form ice structures when the ice tray is in the upright ice forming position. A harvesting mechanism is coupled to the housing in a position disposed above and adjacent to the ice tray. The harvesting mechanism includes a contacting member operable between retracted and extended positions. The contacting member is adapted to contact and move the body portion of the ice tray from an at-rest condition to a deformed condition as the contacting member moves from the retracted position to the extended position. The ice tray is flexibly resilient such that the body portion is adapted to return to the at-rest condition from the deformed condition as the contacting member moves towards the retracted position from the extended position Yet another aspect of the present invention includes an automatic ice maker comprising a housing having one or more contact members fixedly mounted thereto. Eccentric mounting structures are operably coupled to a motor disposed adjacent to and below the contact members. An ice tray is rotatably mounted to the eccentric mounting structures and is operably between an upright ice forming position in an inverted ice harvesting position as powered by the motor. The ice tray further comprises a generally planar body portion having a plurality of open ice forming cavities disposed thereon. One or more notches are disposed on an edge of the body portion of the ice tray and the notches are correspondingly configured relative to the contact members for providing clearance for the contact members as the ice tray is rotated from the ice forming position to the ice harvesting position. The contacting members are adapted to contact and urge the body portion of the ice tray from an at-rest condition to a deformed condition as the ice tray moves from the ice forming position to the ice harvesting position. The ice tray is flexibly resilient such that the body portion of the ice tray is adapted to return to the at-rest condition from the deformed condition as the ice tray moves from the ice harvesting position to the ice forming position.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
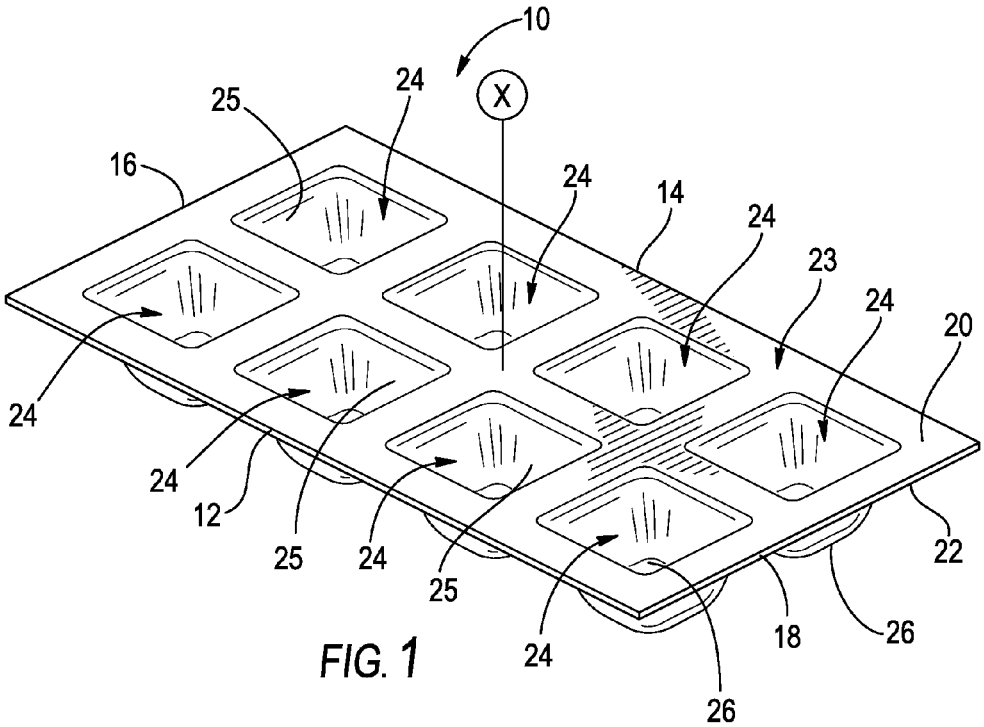
FIG. 1 is a top perspective view of an ice tray.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, the reference numeral 10 generally designates an ice tray used in forming ice structures. As shown in FIG. 1, the ice tray 10 includes a front wall 12, a rear wall 14, and side walls 16, 18. The ice tray 10 further includes an upper planar surface 20 and a lower planar surface 22, which define a generally planar body portion 23. The upper and lower planar surfaces 20, 22 are defined by the front and rear walls 12, 14 along with the side walls 16, 18. The upper and lower planar surfaces 20, 22 are spaced apart approximately 1.75 mm in the embodiment shown in FIG. 1, thereby providing an ice tray 10 which is generally considered a thin mold ice tray. While the embodiment shown in FIG. 1 is configured to represent an ice mold tray 10 having a body portion 23 with planar thickness of approximately 1.75 mm it is contemplated that ice mold trays having a planar thickness in range of about 1 mm to about 3 mm would also be considered thin mold ice trays. Being a thin mold ice tray, ice tray 10 is adapted to be flexibly resilient as further described below.

As further shown in FIG. 1, the ice tray 10 includes multiple ice structure formation cavities 24 having open tops which are adapted to receive a liquid, such as water, for forming ice structures therein. As shown in FIG. 1, the ice structure formation cavities 24 are in the shape of cubed cavities that have generally tapered side walls 25 with a bottom surface 26. While the ice formation cavities 24 generally make for a slightly tapered cube shaped cavity, it is contemplated that any cavity shape known in the art will work with the present invention, including, but not limited to, crescent shaped, cubed shaped, semi-circle shaped, and other like shapes known in the art. The tapered side walls 25 of the ice formation cavity 24 provides for formed ice structures which are more readily harvested from the ice tray 10 when the ice tray 10 is inverted.

As noted above, the ice tray 10 is considered a thin mold ice tray which is flexibility resilient. Thus, the ice tray 10 is preferably made of a flexible material, such as a flexible polymeric material, a thermal plastic material or blends of such materials. One non-limiting example of such material is a polypropylene material. Such polymeric materials provide for an ice tray which is flexibly resilient given the planar thickness of the ice tray. In this way, the ice tray 10 can be deformed to better effectuate the release of formed ice structures from the ice formation cavities 24. Further aiding in the release of formed ice structures from the ice tray 10 are various coatings that can be applied to the polymeric ice tray 10 which are low friction coatings that help to reduce the formation of mechanical bonds between the side walls 25 and bottom surface 26 of the ice formation cavities 24 and the ice structure formed therein. Such coatings can include, but are not limited to, organosilicon based compounds or polymerized siloxanes. Other coatings known in the art that can help to reduce the formation of bonds between a formed ice structure and the ice formation cavities 24 include various non-stick coatings like flouropolymeric coatings, teflon and parylene-based coatings.

Figure 2:
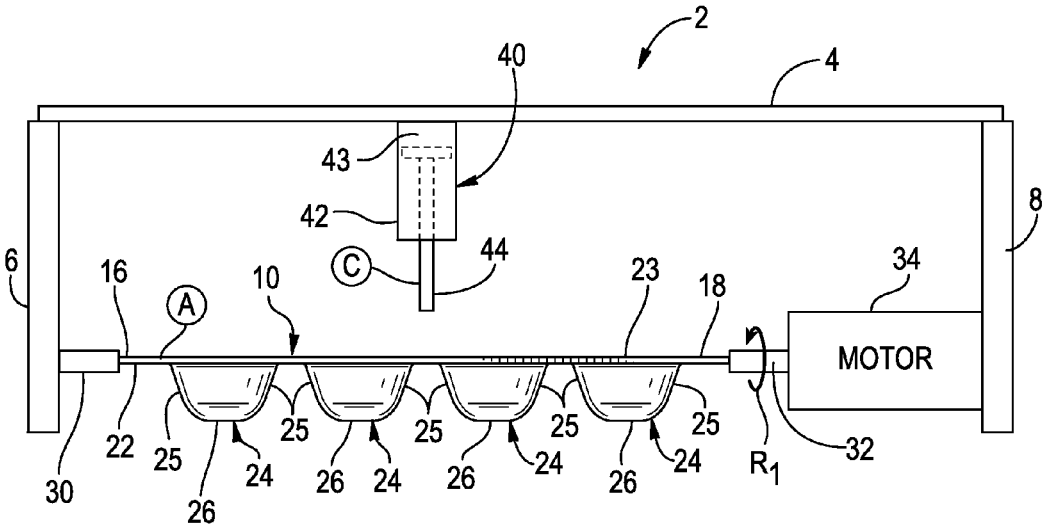
FIG. 2 is a side elevational view of the ice tray of FIG. 1 as disposed in an ice maker.
Figure 3:
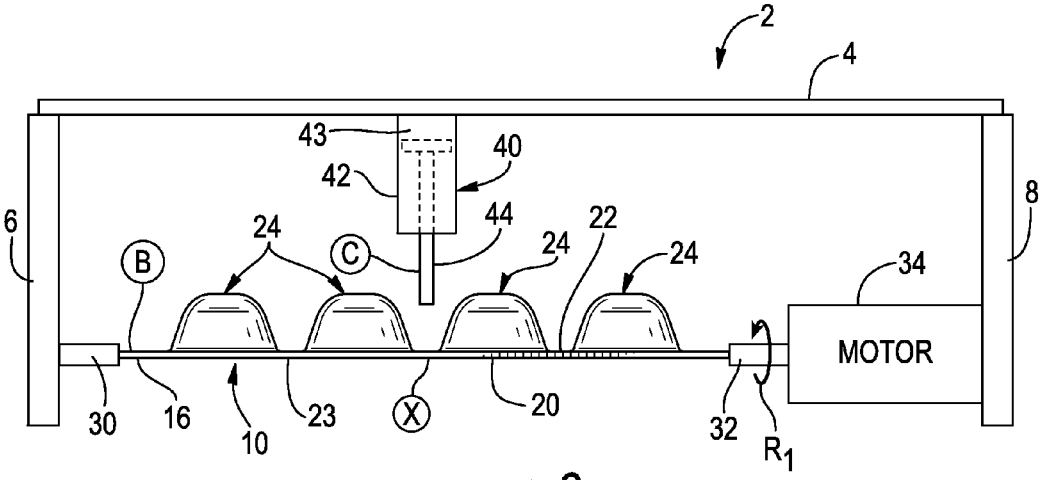
FIG. 3 is a side elevational view of the ice maker of FIG. 2 with the ice tray inverted.

Referring now to FIGS. 2-5, the operation of the ice maker 2 will be described for one complete ice making cycle. As shown in FIG. 2, the ice tray 10 is in an ice forming position A. In this position, the ice tray 10 is generally upright such that the ice formation cavities 24 are in a position to receive and hold water during the ice forming process. As the ice formation cavities 24 are filled with a liquid, which in most cases will be water, the ice tray 10 will likely include a spillway which allows for the cavities 24 to be in fluid communication with one another such that a single water source can be used to fill the cavities 24. The ice maker 2 includes a housing defined by an upper portion 4 and side walls 6 and 8. A pivotal mounting member 30 is coupled to side wall 6 and further coupled to side wall 16 of the ice tray 10. At the other side wall 18 of the ice tray 10, a fixed mounting member 32 is disposed which is pivotally coupled to a motor 34 which is further mounted to the side wall 8 of the ice maker 2. In operation, the motor 34 is adapted to rotate the mounting member 32 in a direction as indicated by arrow R1, such that the ice tray 10 can move from the ice forming position A to an ice harvesting position B, as shown in FIG. 3. While rotating the ice tray 10, pivotal mounting structure 30 is fixedly coupled to the ice tray 10 and pivotally coupled to side wall 6 of the ice maker 2.

Figure 4:
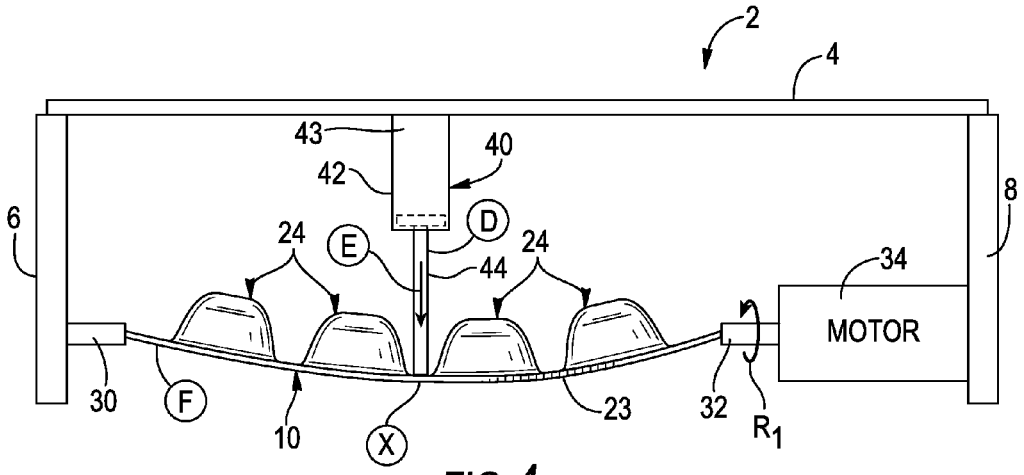
FIG. 4 is a side perspective view of the ice maker of FIG. 3 having the ice tray in a deformed position.
Figure 5:
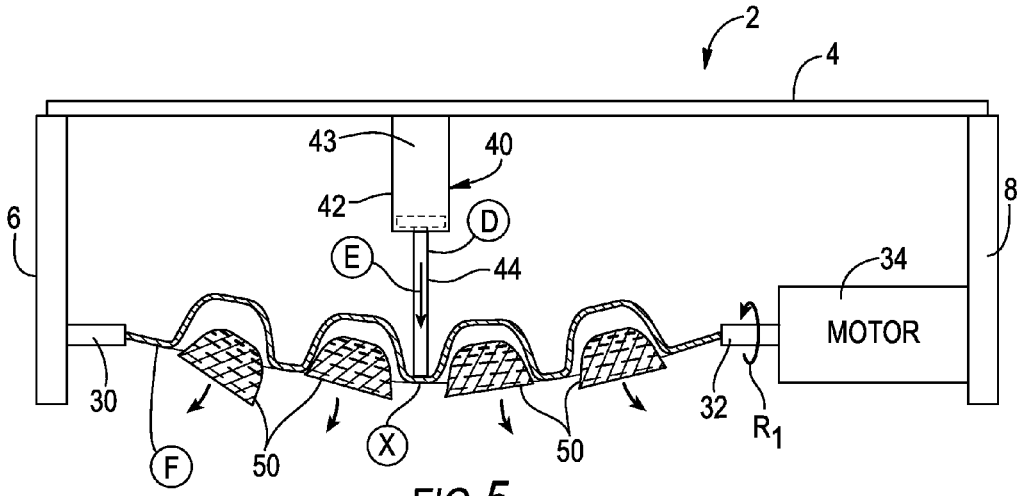
FIG. 5 is a side cross-sectional view of the ice maker of FIG. 4 indicating release of ice structures from the ice maker.

During the ice harvesting process, a harvesting mechanism 40 is coupled to the upper portion 4 of the ice maker 2, such that the harvesting mechanism 40 is generally disposed above the ice tray 10 in assembly. The harvesting mechanism 40 includes a motor 42 and a contacting member 44 which is moveable by the motor 42 between a retracted position C (FIGS. 2 and 3) and an extended position D (FIGS. 4 and 5). In the retracted position C, the contacting member 44 is partially disposed within the interior 43 of the motor 42. In the retracted position C, the contacting member 44 is in a position located between adjacent ice formation cavities 24, such that the ice tray 10 can rotate freely without contacting the contacting member 44 as the ice tray 10 moves from the ice formation position A to the ice harvesting position B. It is contemplated that the ice harvesting mechanism 40 may include an electrical solenoid having an armature used as the contacting member 44, or a pneumatic piston, wherein a piston rod serves as the contacting member 44. Other like devices known in the art would also be suitable for use with the present invention. As shown in FIG. 3, the harvesting mechanism 40 is disposed above the ice tray 10 in a generally central location, such that the contacting member 44 is directly disposed above a middle contacting point X as shown in FIGS. 1 and 3.

In harvesting ice structures from the ice maker 2, the contacting member 44 is adapted to move to the extended position D along a path as indicated by arrow E in FIGS. 4 and 5. In the extended position D, the contacting member 44 is generally disposed outside of the interior 43 of the motor 42. In this way, the contacting member 44 contacts the ice tray 10 at the centrally located contact point X such that the ice tray 10 deforms to a deformed position F. In the deformed position F, the cavities 24 also deform to expel formed ice structures 50 from the ice tray 10 as shown in FIG. 5. Generally, the formed ice structures 50 will gravitationally fall from the ice tray 10 upon deformation of the ice tray 10 by the harvesting mechanism 40, such that the formed ice structures 50 will collect in an ice collection bin, not shown.

As noted above, the ice tray 10 is comprised of a flexibly resilient material, such that the thin mold configuration of the ice tray 10 allows for the ice tray to return to an at-rest position, shown in FIGS. 2 and 3, from the deformed position F, shown in FIGS. 4 and 5. The resiliency of the ice tray 10 allows for a prolonged life in use, as the ice tray 10 can be deformed by the harvesting mechanism 40 multiple times and resiliently revert back to its predisposed or at-rest condition in preparation for continuing ice formation cycles.

Figure 6A:
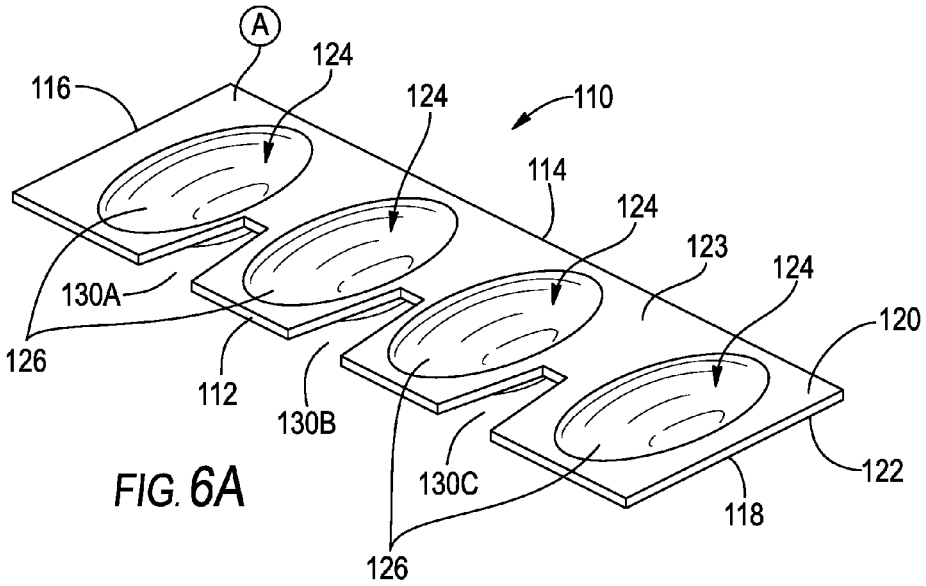
FIG. 6A is a top perspective view of an ice tray according to another embodiment of the present invention.
Figure 6B:
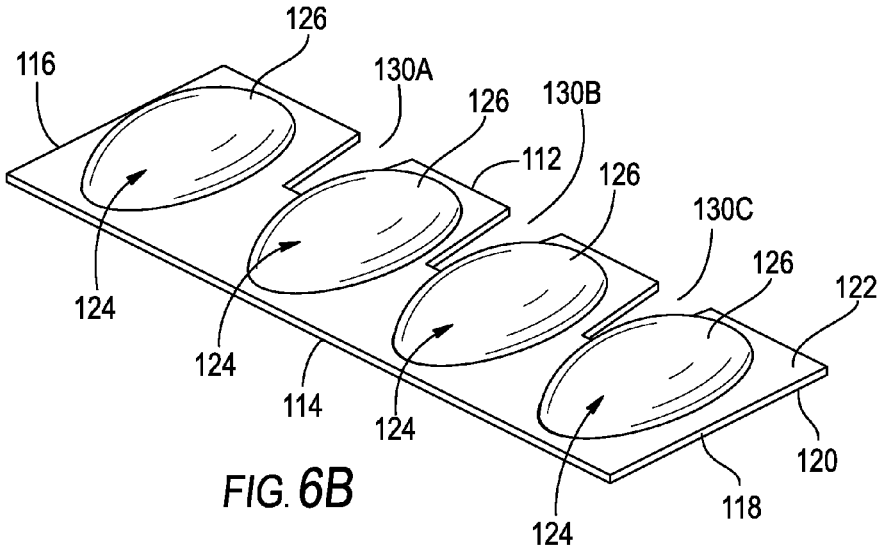
FIG. 6B is a bottom perspective view of the ice tray of FIG. 6A.

Referring now to FIG. 6A, the reference numeral 110 generally designates an ice tray of another embodiment of the present invention as used in forming ice structures. As shown in FIG. 6A, the ice tray 110 includes a front wall 112, a rear wall 114, and side walls 116, 118. The ice tray 110 further includes an upper planar surface 120 and a lower planar surface 122, which define a generally planar body portion 123. The upper and lower planar surfaces 120, 122 are defined by the front and rear walls 112, 114 along with the side walls 116, 118. The upper and lower planar surfaces 120, 122 are spaced apart approximately 1 mm in the embodiment shown in FIG. 6A, thereby providing an ice tray 110 which is generally considered a thin mold ice tray. While the embodiment shown in FIG. 6A is configured to represent an ice mold tray 110 having a body portion 123 with planar thickness of approximately 1 mm it is contemplated that ice mold trays having a planar thickness in range of about 1 mm to about 3 mm would also be considered thin mold ice trays. Being a thin mold ice tray, ice tray 110 is adapted to be flexibly resilient as further described below.

As further shown in FIG. 6A, the ice tray 110 includes multiple serially aligned ice structure formation cavities 124 having open tops which are adapted to receive a liquid, such as water, for forming ice structures therein. As shown in FIG. 6A, the ice structure formation cavities 124 are in the shape of rounded oval-like cavities that have a generally sloped bottom surface 126. While the ice formation cavities 124 generally make for a rounded oval-like cavity, it is contemplated that any cavity shape known in the art will work with the present invention, including, but not limited to, crescent shaped, cubed shaped, semi-circle shaped, and other like shapes known in the art.

As noted above, the ice tray 110 is considered a thin mold ice tray which is flexibly resilient such that the ice tray 110 may be similarly comprised of a flexibly resilient material such as the materials noted above with reference to ice tray 10. Further, similar coatings identified for use with reference to ice tray 10 may also be incorporated for use with the ice tray 110 as found in FIG. 6A.

As shown in FIG. 6A, front wall 112 is considered a leading wall or leading edge such that as the ice tray 110 rotates between ice forming positions and ice harvesting positions, as further described below, in a manner such that the leading edge 112 will lead the rotation of the ice tray as further described below. Notches 130A, 130B and 130C are disposed at various points along the leading edge 112 and recess into the planar body portion 123 of the ice tray 110, wherein in the notches 130 are adapted to provide clearance to contacting members disposed in the ice maker as further described below with reference to FIGS. 7-9. The notches 130A, 130B, and 130C comprise slots which are suitable in configuration to provide for clearance of contacting members, which may be of varying lengths relative to one another.

Figure 7:
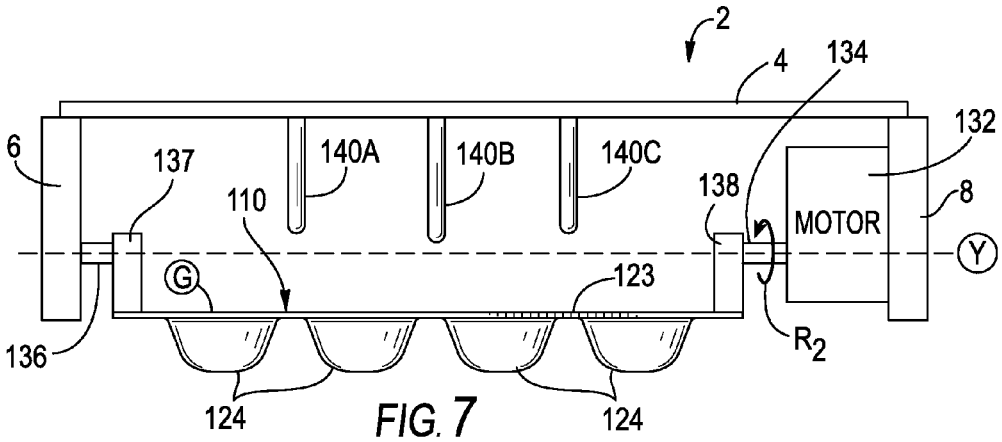
FIG. 7 is a side elevational view of the ice tray of FIG. 6A as disposed in an ice maker.
Figure 8:
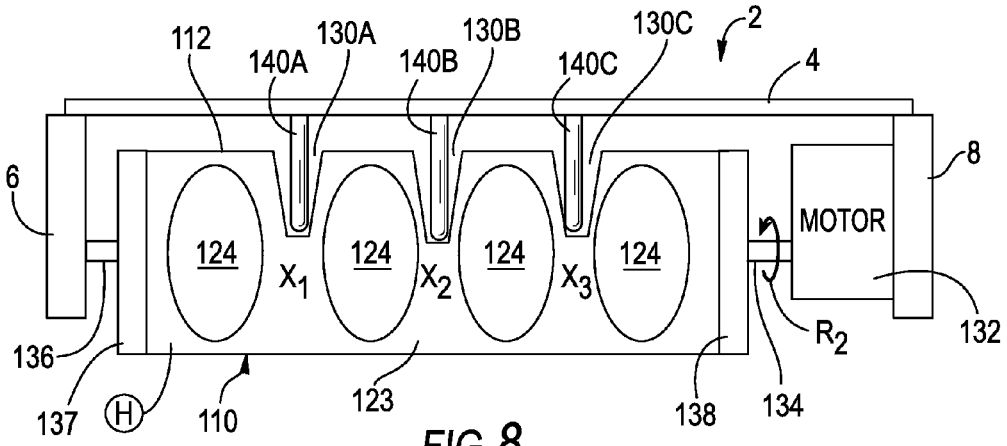
FIG. 8 is a side elevational view of the ice maker of FIG. 7 having the ice tray in a partially inverted position.
Figure 9:
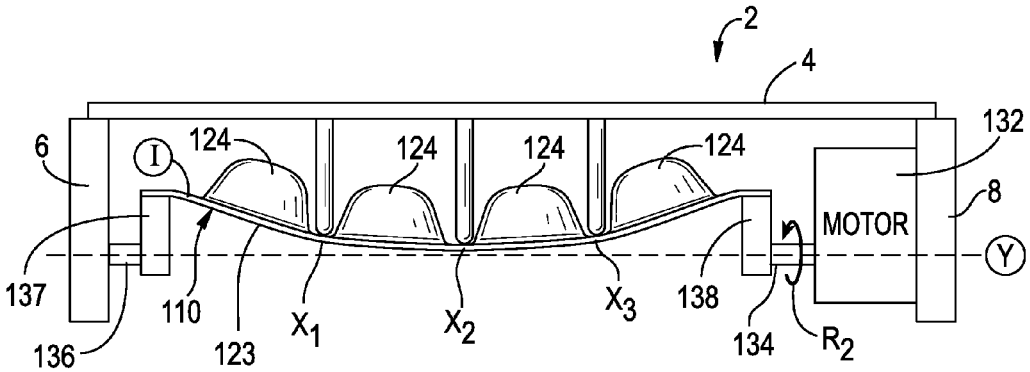
FIG. 9 is a perspective view of the ice tray of FIG. 8 having the ice tray in a deformed position.

Referring now to FIGS. 7-9, an ice maker 2 includes a housing defined by an upper portion 4 having side walls 6 and 8. A motor 132 is mounted to side wall 8 and includes a mounting member 134 which is adapted to rotate in a circular motion as indicated by arrow R2. A pivotal mounting member 136 is pivotally coupled to side wall 6 of the ice maker 2, wherein mounting members 134, 136 are further coupled to eccentric mounting structures 137, 138, such that a horizontal rotational axis indicated by arrow Y is associated with an upper portion of the eccentric mounting members 137, 138 such that the eccentric mounting members 137, 138 provide an offset feature to the ice tray 110 as mounted within the ice maker 2. The motor 132 is adapted to rotate the ice tray 110 from an at-rest position G, shown in FIG. 7, to an intermediate position H, shown in FIG. 8, and a fully inverted ice harvesting position I, shown in FIG. 9. The at-rest position G defines an ice formation position for the ice tray 110, while the fully inverted position I defines an ice harvesting position for the ice tray 110.

Figure 10:
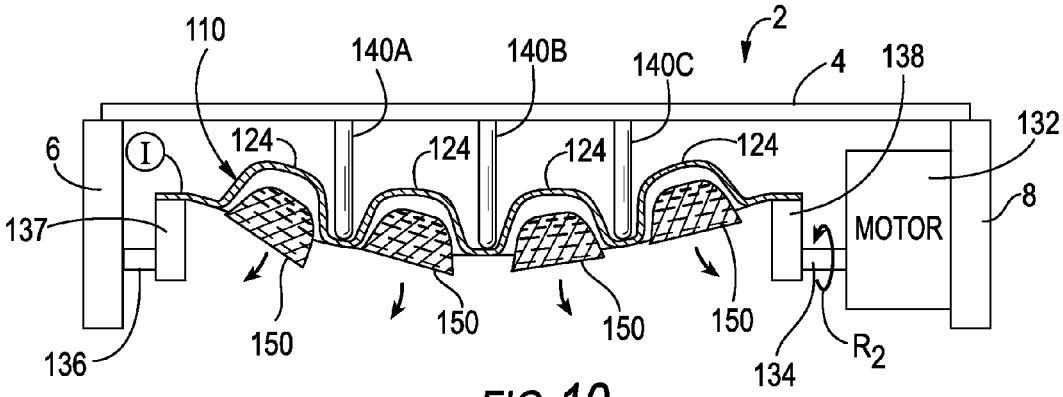
FIG. 10 is a cross-sectional side elevational view of the ice maker of FIG. 9 indicating relative movement of ice structures formed therein as released from the ice tray.

As further shown in FIGS. 7-9, contacting members 140A, 140B and 140C are mounted to the upper portion 4 of the ice maker 2. The contacting members 140A, 140B and 140C are shown in the embodiment of FIGS. 7-9 in the form of stationary contacting rods. In assembly, it is contemplated that the contacting rods 140A, 140B and 140C are fixedly mounted to the upper portion 4 of the ice maker 2. As shown in FIG. 8, the contacting members 140A, 140B and 140C are adapted to align with the notches 130A, 130B and 130C as disposed on the ice tray 110 as mounted within the ice maker 2. Thus, as the ice tray 110 rotates from the at-rest position G to the intermediate position H, the notches 130A, 130B and 130C align with and provide clearance for contacting members 140A, 140B and 140C respectively. As the ice tray 110 further rotates from the intermediate position H to the ice harvesting and deformed position I, the contacting members 140A, 140B and 140C are adapted to contact the generally planar body portion 123 of the ice tray 110 at contact points X1, X2 and X3. In this way, the contacting members 140A, 140B and 140C deform the ice tray 110, thereby aiding in the release of ice structures formed within the ice formation cavities 124. Referring now to FIG. 10, formed ice structures 150 are shown being released from the cavities 124 of the ice tray 110. Once the formed ice structures 150 have been released from the ice tray 110, the ice tray 110 is rotated in an opposite direction, thereby moving the ice tray 110 from the inverted position I to the intermediate position H, as shown in FIGS. 8 and 9. In this way, the notches 130A, 130B and 130C provide clearance for the fixed contacting members 140A, 140B and 140C as the ice tray 110 rotates and returns to the at-rest or ice forming position G shown in FIG. 7.

As noted above, the ice tray 110 is mounted to eccentric mounting structures 137, 138 such that the ice tray 110 is substantially disposed below a horizontal axis of rotation Y in the at-rest position G by the offset nature of the eccentric mounting structures 137, 138. Further, given the offset nature of eccentric mounting members 137, 138, the ice tray 110 is substantially disposed above the rotational axis Y in the fully inverted position I shown in FIGS. 9 and 10. Thus, the offsetting feature defined by the eccentric mounting structures 137, 138 allows for the ice tray 110 to freely rotate from the at-rest position G to the intermediate position H without interference from the contacting members 140A, 140B and 140C. Further, the offsetting feature defined by the eccentric mounting structures 137, 138 provides for a positional configuration of the ice tray in the inverted position I, such that the ice tray 110 deforms by contacting the fixed contacting members 140A, 140B and 140C to aid in the release of deformed ice structures 150.

Further, it is contemplated that the fixed contacting members 140A, 140B and 140C can be of varying lengths, such that, in the embodiment shown in FIGS. 7-10, the contacting members 140A and 140C are outer stationary rods of a similar length. Contacting member 140B is centrally located relative to outer stationery rods 140A, 140C and generally is longer than the outer stationary rods 140A, 140C. In this way, the centrally located stationary rod 140B is adapted to contact point X2 disposed on the generally planar body portion 123 of the ice tray 110 to provide a more pronounced flexure of the ice tray 110 at a central location.

Figure 11:
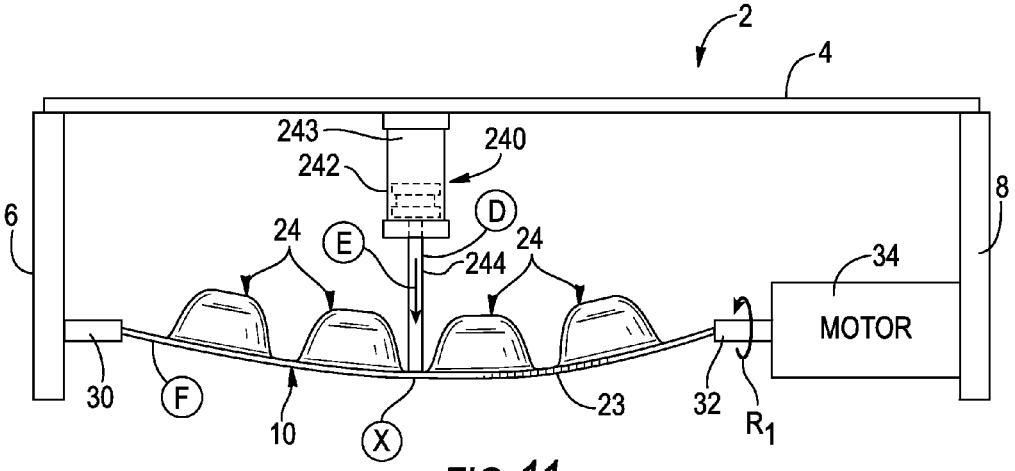
FIG. 11 is a side perspective view of the ice maker of FIG. 3 having the ice tray in a deformed position and an alternate harvesting mechanism which includes a pneumatic piston.

As can be seen in FIG. 11, an alternative harvesting mechanism is shown. In the exemplary embodiment of FIG. 11, reference numeral 240 represents an ice harvesting mechanism which includes a pneumatic piston. Element 242 is the pneumatic piston. Element 243, shown in dashed lines, represents the inside of the piston 242. The piston rod or contacting member is represented by 244. The piston rod or contacting member is configured to move between retracted or extended positions.

Figure 12:
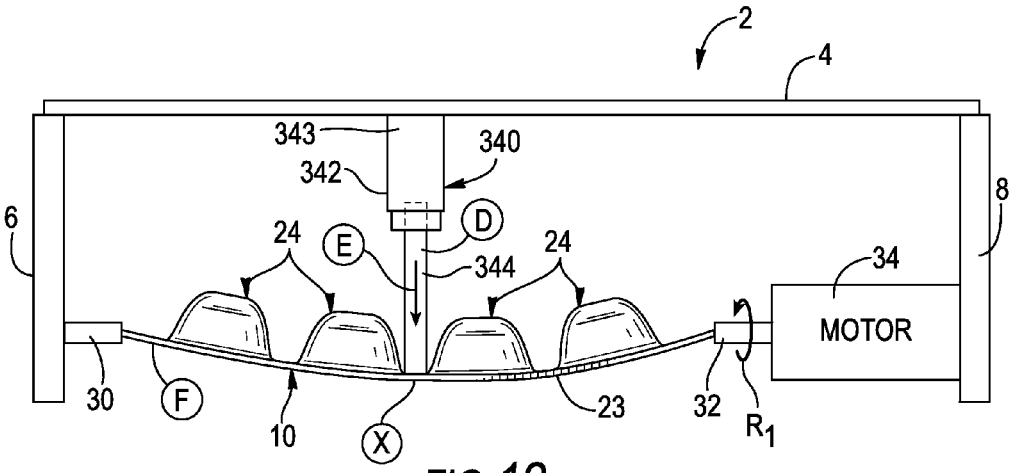
FIG. 12 is a side perspective view of the ice maker of FIG. 3 having the ice tray in a deformed position and an alternate harvesting mechanism which includes an electric solenoid.

As can be seen in FIG. 12, another alternate harvesting mechanism is shown. In the exemplary embodiment of FIG. 12, element 340 represents an electrical solenoid. Element 343, shown in dashed lines, represents the interior of the solenoid. In addition, the contacting member is represented by 340. The contacting member is an armature configured to move between retracted and extending positions. FIGS. 11 and 12 are otherwise the same as the embodiment shown in FIG. 4.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. An automatic ice maker, comprising:

a housing;

an ice tray moveably mounted to the housing and operable between an ice forming position and an ice harvesting position, the ice tray further comprising a generally planar body portion having a plurality of ice forming cavities disposed thereon;

each ice forming cavity having an open top and a closed bottom surface for receiving a liquid and holding the liquid to form ice structures; and a harvesting mechanism coupled to the housing and operable between retracted and extended positions, the harvesting mechanism adapted to engage and deform the ice tray in the extended position when the ice tray is in the ice harvesting position to aid in the release of the ice structures from the ice tray; wherein the harvesting mechanism comprises an electrical solenoid having an armature operable between the extended and retracted positions or the harvesting mechanism comprises a pneumatic piston having a piston rod operable between the extended and retracted positions.

2. The automatic ice maker of claim 1, including:

a motor coupled to the ice tray and the housing, wherein the motor is adapted to move the ice tray between the ice forming position and the ice harvesting position.

3. The automatic ice maker of claim 2, wherein:

the motor is a reversible electric motor, and further wherein the motor is adapted to rotate the ice tray between the ice forming position and the ice harvesting position.

4. The automatic ice maker of claim 3, wherein:

the ice tray is in an upright position in the ice forming position and is inverted from the upright position in the ice harvesting position.

5. The automatic ice maker of claim 1, wherein:

the harvesting mechanism comprises an electrical solenoid having an armature operable between the extended and retracted positions.

6. The automatic ice maker of claim 1, wherein:

the harvesting mechanism comprises a pneumatic piston having a piston rod operable between the extended and retracted positions.

7. The automatic ice maker of claim 1, wherein:

the ice tray is a thin mold ice tray that is flexibly resilient.

8. The automatic ice maker of claim 7, wherein:

the ice tray comprises one of a polymeric material and a metallic material.

9. An automatic ice maker, comprising:

a housing;

an ice tray rotatably mounted within the housing and operable between an upright ice forming position and an inverted ice harvesting position, the ice tray further comprising a generally planar body portion having a plurality of open ice forming cavities disposed thereon;

each ice forming cavity having an open top and a closed bottom surface for receiving a liquid and holding the liquid to form ice structures when the ice tray is in the upright ice forming position; and a harvesting mechanism coupled to the housing in a position disposed above and adjacent to the ice tray, the harvesting mechanism having a contacting member operable between retracted and extended positions, wherein the contacting member is adapted to contact and move the body portion of the ice tray from an at-rest condition to a deformed condition as the contacting member moves from the retracted position to the extended position, and further wherein the ice tray is flexibly resilient such that the body portion is adapted to return to the at-rest condition from the deformed condition as the contacting member moves towards the retracted position from the extended position; wherein the harvesting mechanism comprises an electrical solenoid having an armature operable between the extended and retracted positions or the harvesting mechanism comprises a pneumatic piston having a piston rod operable between the extended and retracted positions.

10. The automatic ice maker of claim 9, including:

a motor coupled to the ice tray and the housing, wherein the motor is adapted to move the ice tray between the ice forming position and the ice harvesting position.

11. The automatic ice maker of claim 10, wherein:

the motor is a reversible electric motor, and further wherein the motor is adapted to rotate the ice tray between the ice forming position and the ice harvesting position.

12. The automatic ice maker of claim 11, wherein:

the harvesting mechanism comprises an electrical solenoid, and further wherein the contacting member comprises an armature operable between the extended and retracted positions.

13. The automatic ice maker of claim 11, wherein:

the harvesting mechanism comprises a pneumatic piston, and further wherein the contacting member comprises a piston rod operable between the extended and retracted positions.

14. The automatic ice maker of claim 9, wherein:

the ice tray is a thin mold ice tray.

15. An automatic ice maker, comprising:

a housing;

one or more contact members fixedly mounted to an upper portion of the housing;

eccentric mounting structures operable coupled to a motor disposed adjacent to and below the one or more contact members;

an ice tray mounted to the eccentric mounting structures and operable between an upright ice forming position and an inverted ice harvesting position as powered by the motor, the ice tray further comprising a generally planar body portion having a plurality of open ice forming cavities disposed thereon;

one or more notches disposed on an edge of the body portion of the ice tray, wherein the notches are correspondingly configured relative to the contact members for providing clearance for the contact members when the ice tray is rotated between the ice forming position and the ice harvesting position; and wherein the contacting members are adapted to contact and urge the body portion of the ice tray from an at-rest condition to a deformed condition as the ice tray moves from the ice forming position to the ice harvesting position, and further wherein the ice tray is flexibly resilient such that the body portion of the ice tray is adapted to return to the at-rest condition from the deformed condition as the ice tray moves from the ice harvesting position to the ice forming position, and further wherein the harvesting mechanism comprises an electrical solenoid having an armature operable between the extended and retracted positions or the harvesting mechanism comprises a pneumatic piston having a piston rod operable between the extended and retracted positions.

16. The automatic ice maker of claim 15, wherein:

the contact members comprise stationary rods.

17. The automatic ice maker of claim 16, wherein:

the notches comprise slots disposed along the edge of the ice tray to accommodate the shape of the stationary rods.

18. The automatic ice maker of claim 17, wherein:

the ice tray is mounted to the eccentric mounting structures, such that the planar body portion of the ice tray is disposed below a horizontal rotational axis when the ice tray is in the upright ice forming position, and further wherein the planar body portion of the ice tray is disposed above the horizontal rotational axis when the ice tray is in the inverted ice harvesting position.

19. The automatic ice maker of claim 18, wherein:

the contact members comprise outer stationary rods disposed on opposite sides of a central stationary rod, wherein the central stationary rod is longer than the outer stationary rods, and further wherein the notches are disposed on a leading edge of the ice tray.

20. The automatic ice maker of claim 19, wherein:

the ice tray is a thin mold ice tray.

* * * * *